US011162166B2

(12) United States Patent
Kobayashi

(10) Patent No.: US 11,162,166 B2
(45) Date of Patent: Nov. 2, 2021

(54) APPARATUS FOR CONTINUOUS MOLTEN METAL COATING TREATMENT AND METHOD FOR MOLTEN METAL COATING TREATMENT USING SAME

(71) Applicant: JFE STEEL CORPORATION, Tokyo (JP)

(72) Inventor: Hirokazu Kobayashi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 37 days.

(21) Appl. No.: 16/486,839

(22) PCT Filed: Feb. 9, 2018

(86) PCT No.: PCT/JP2018/004731
§ 371 (c)(1),
(2) Date: Aug. 19, 2019

(87) PCT Pub. No.: WO2018/155245
PCT Pub. Date: Aug. 30, 2018

(65) Prior Publication Data

US 2020/0232082 A1 Jul. 23, 2020

(30) Foreign Application Priority Data

Feb. 24, 2017 (JP) ..... JP2017-034018

(51) Int. Cl.
*C23C 2/00* (2006.01)
*C23C 4/123* (2016.01)
(Continued)

(52) U.S. Cl.
CPC ..... *C23C 2/003* (2013.01); *C23C 2/06* (2013.01); *C23C 4/06* (2013.01); *C23C 4/123* (2016.01);
(Continued)

(58) Field of Classification Search
CPC .. C23C 2/003; C23C 2/40; C23C 2/24; C23C 4/123; C23C 2/06; C23C 4/06;
(Continued)

(56) References Cited

U.S. PATENT DOCUMENTS 5,377,961 A 1/1995 Smith et al.
5,831,643 A * 11/1998 Chung ..... B41J 2/04528 347/17
(Continued)

FOREIGN PATENT DOCUMENTS

CN 1396005 A 2/2003
CN 1639374 A 7/2005
(Continued)

OTHER PUBLICATIONS

English Translation of JP55-097462A, Nagawa, published Jul. 24, 1980. (Year: 1980).*
(Continued)

*Primary Examiner* — Laura Edwards
(74) *Attorney, Agent, or Firm* — Kenja IP Law PC

(57) ABSTRACT

The disclosure provides a fully new method for molten metal coating treatment coating treatment, as a method for treating surfaces of a metal strip by molten metal coating, by which inherent issues in conventional immersion coatings and spray coatings are avoided. In the disclosed method for molten metal coating treatment, a surface of a metal strip is coated by discharging a droplet of a molten metal toward the surface of the metal strip, using a nozzle system configured to discharge the droplet of the molten metal from a nozzle due to an action of the Lorentz force generated on the molten metal by sending an electric current to the molten metal in a chamber, the chamber being applied with magnetic flux in a given direction, while the electric current sent in a direction perpendicular to the given direction.

12 Claims, 6 Drawing Sheets

(51) Int. Cl.

| | |
|---|---|
| ***C23C 2/06*** | (2006.01) |
| ***C23C 4/06*** | (2016.01) |
| ***C23C 4/14*** | (2016.01) |
| ***B05C 5/02*** | (2006.01) |
| ***B05D 1/00*** | (2006.01) |

(52) U.S. Cl.
CPC ..... *C23C 4/14* (2013.01); *B05C 5/0291* (2013.01); *B05D 1/00* (2013.01)

(58) Field of Classification Search
CPC ..... C23C 4/08; C23C 4/14; B22F 2009/0836; B22F 9/08; B23K 3/06; B05C 5/0291; B05C 9/14; B05D 1/00; B05D 2202/00
USPC ..... 118/629, 58; 427/422
See application file for complete search history.

(56) References Cited

U.S. PATENT DOCUMENTS

| | | | | |
|---|---|---|---|---|
| 6,224,180 | B1 * | 5/2001 | Pham-Van-Diep | B05B 5/001 347/2 |
| 7,214,272 | B2 | 5/2007 | Hartung et al. | |
| 2003/0029379 | A1 | 2/2003 | Onogawa et al. | |
| 2011/0187798 | A1 * | 8/2011 | Rogers | B41J 2/09 347/55 |
| 2014/0366802 | A1 | 12/2014 | Itoh et al. | |

FOREIGN PATENT DOCUMENTS

| | | | |
|---|---|---|---|
| CN | 102676974 | A | 9/2012 |
| EP | 0525387 | A1 | 2/1993 |
| EP | 2167697 | B1 | 8/2012 |
| EP | 2652167 | B1 | 4/2015 |
| JP | S5597462 | A | 7/1980 |
| JP | S5715664 | B2 | 3/1982 |
| JP | S5810985 | B2 | 2/1983 |
| JP | S60258458 | A | 12/1985 |
| JP | H01201456 | A | 8/1989 |
| JP | H04329856 | A | 11/1992 |
| JP | H06179956 | A | 6/1994 |
| JP | H07305157 | A | 11/1995 |
| JP | H08165555 | A | 6/1996 |
| JP | H08218160 | A | 8/1996 |
| JP | 2007284775 | A | 11/2007 |
| JP | 2009167473 | A | 7/2009 |
| JP | 2009263698 | A | 11/2009 |
| JP | 2016041003 | A | 3/2016 |
| KR | 20030054623 | A | 7/2003 |
| WO | 2010063576 | A1 | 6/2010 |

OTHER PUBLICATIONS

English Translation of KR20030054623, Jung, published Jul. 2, 2003. (Year: 2003).*

Mar. 27, 2018, International Search Report issued in the International Patent Application No. PCT/JP2018/004731.

Nov. 26, 2019, the Extended European Search Report issued by the European Patent Office in the corresponding European Patent Application No. 18756725.0.

Dec. 1, 2020, Office Action issued by the China National Intellectual Property Administration in the corresponding Chinese Patent Application No. 201880012962.5 with English language search report.

Jan. 2, 2021, Office Action issued by the Korean Intellectual Property Office in the corresponding Korean Patent Application No. 10-2019-7024374 with English language concise statement of relevance.

Jul. 5, 2021, Office Action issued by the Korean Intellectual Property Office in the corresponding Korean Patent Application No. 10-2019-7024374 with English language concise statement of relevance.

* cited by examiner

APPARATUS FOR CONTINUOUS MOLTEN METAL COATING TREATMENT AND METHOD FOR MOLTEN METAL COATING TREATMENT USING SAME

TECHNICAL FIELD

The present disclosure relates to an apparatus for continuous molten metal coating treatment for continuously molten metal coating a travelling metal strip, and to a method for molten metal coating treatment using the apparatus.

BACKGROUND

Conventionally, hot-dip metal coating on a metal strip, for example, hot-dip galvanizing on a steel strip, is generally performed in a continuous hot-dip galvanizing line as illustrated in FIG. 8. In such a line, a steel strip S, annealed in a continuous annealing furnace under a reducing atmosphere, passes through a snout 81 and continuously introduced into a molten zinc bath 83 placed in a coating tank 82. The steel strip S is then pulled up above the molten zinc bath 83 via a sink roll 84 immersed in the molten zinc bath 83, adjusted to a predetermined coating thickness by a pair of gas wiping nozzles 85, cooled, and led to subsequent processes.

In this continuous hot-dip metal coating line, the molten zinc, adhered to surfaces of the steel strip and being pulled up, is wiped from the steel strip so as to control to a desired coating weight, by discharging heated gas or gas at ordinary temperature from the gas wiping nozzles 85 to blow the gas onto the surfaces of the steel strip S. This gas wiping method is widely used at present.

If impinging pressure of the gas on the steel strip is increased when controlling the coating weight of the molten zinc by the above method, however, there arises a problem that a coated surface will have a defective appearance. This is due to splattering of the molten zinc, called splashing, occurred by increase in gas flow rate, resulting in that the splattered molten zinc adheres to the steel strip surfaces again. In addition, zinc entrains air to build up as a lumpy mass of oxide (dross) on the bath surface, as the zinc bath is in contact with atmospheric air. There is therefore another problem that the dross adheres to the steel strip to cause the defective appearance on the coated surface. Furthermore, while increase in the impinging pressure of the gas is required in order to obtain thin coatings, a coating amount for the hot-dip galvanizing of about 30 g/m$^2$ will be the lower limit for now because a warp or vibration of the steel strip makes it difficult to reduce a distance between the nozzle and the steel strip.

Techniques as described in PTL 1 to 3 are known as means for solving these problems. PTL 1 discloses a method for controlling a hot-dip coating weight in which the coating weight is controlled by blowing burner exhaust gas from a wiping nozzle toward a surface of a metal strip being continuously pulled up from a hot-dip metal coating bath.

PTL 2 discloses a method for wiping a molten metal using an electromagnetic force by disposing a pair of electromagnetic coils to face both surfaces of a steel strip being continuously pulled up from a hot-dip metal coating bath. In PTL 2, such a method for controlling a coating weight is disclosed as a method to replace the gas wiping method.

PTL 3 discloses a method for molten metal coating where a steel strip is spray coated by spraying fine particles of a molten metal, from a pair of spray nozzles provided to face each other with the steel strip in between, on surfaces of the steel strip continuously travelling to be supplied. In PTL 3, such a method for coating treatment is disclosed as a method to replace a method where the metal strip is immersed in the molten metal.

CITATION LIST

Patent Literature

PTL 1: JP 2009-263698 A
PTL 2: JP 2007-284775 A
PTL 3: JP H8-165555 A

SUMMARY

Technical Problem

However, problems of the splashing and the dross remain after all in the method described in PTL 1, as it is still the gas wiping method using the gas impinging pressure even if the method of PTL 1 allows to reduce amount of gas by enhancing wiping efficiency using the exhaust gas burnt to a high temperature.

The method described in PTL 2 needs to send a large electric current to the electromagnetic coils in order for thin coatings, resulting in a problem that the steel strip will be heated. Moreover, the method requires a zinc bath, thus leaving the problem, of the dross formed in the bath or on the bath surface due to contact with air, unsolved.

Groups of fine particles of the molten metal diffuse to reach the steel strip surfaces in the spray coating method described in PTL 3. Issues therefore arise such that flow rate density of the fine particles mass varies on the steel strip surfaces to produce distribution in coating thickness, and such that the fine particles of the molten metal are sprayed on outside of edges of the steel strip as well to worsen a throughput yield for the molten metal. Moreover, other issues also occur such that extremely fine mist, as a result of variation in fine particle sizes, floats within a furnace without adhering to the steel strip, resulting in poorer throughput yield for the molten metal or contamination within the furnace.

In view of the aforementioned problems, it could be helpful to provide a totally new method for molten metal coating treatment as a method for treating surfaces of a metal strip by molten metal coating, the new method avoiding inherent issues involved in conventional immersion coating processes and spray coating processes. It could also be helpful to provide an apparatus for continuous molten metal coating treatment capable of carrying out such a method.

Solution to Problem

With the aim to solve the aforementioned problems, we have reached discoveries of a method and an apparatus by which it is possible to produce a coated metal strip having a quality surface by utilizing an electromagnetic force (the Lorentz force) to discharge droplets of a molten metal from a nozzle onto the metal strip. We thus provide the followings.

(1) An apparatus for continuous hot dip molten metal coating treatment including:

a coating furnace defining a space of a non-oxidizing atmosphere in which a metal strip continuously travels; and a nozzle system configured to discharge a molten metal droplet toward a surface of the metal strip, the nozzle system including:

a nozzle cartridge defining a chamber through which a molten metal passes, and having a nozzle, on a tip of the nozzle cartridge, that defines a discharge port in communication with the chamber;

a magnetic flux generation mechanism configured to generate magnetic flux in a given direction in at least a part of the chamber; and a current generation mechanism configured to send an electric current, in a direction perpendicular to the given direction, to the molten metal positioned in the at least a part of the chamber where the magnetic flux is applied, wherein the nozzle system is configured to discharge a droplet of the molten metal from the discharge port toward the surface of the metal strip due to an action of the Lorentz force generated on the molten metal by sending the electric current to the molten metal using the current generation mechanism.

(2) The apparatus for continuous molten metal coating treatment according to the foregoing (1), the apparatus further including:

a heating mechanism configured to heat the metal strip; and a controller of the heating mechanism configured to control a temperature of the metal strip to (Tu −20° C.) or more (in other words, a controller of the heating mechanism configured to control the metal strip to a temperature equal to or higher than Tu −20° C.), where a melting point of the molten metal is expressed in Tu (° C.).

(3) The apparatus for continuous molten metal coating treatment according to the foregoing (1) or (2), the apparatus further including a sealing device configured to separate the space of the non-oxidizing atmosphere from air, the sealing device disposed at a side in the coating furnace where the metal strip leaves.

(4) The apparatus for continuous molten metal coating treatment according to any one of the foregoings (1) to (3), the apparatus further including a damping-straightening mechanism configured to suppress the metal strip from vibrating or warping, the damping-straightening mechanism set on at least one of an upstream side or a downstream side of the nozzle system with respect to a travelling direction of the metal strip.

(5) The apparatus for continuous molten metal coating treatment according to any one of the foregoings (1) to (4), wherein the nozzle on the tip of the nozzle cartridge has a plurality of the discharge ports disposed in a transverse direction of the metal strip.

(6) The apparatus for continuous molten metal coating treatment according to the foregoing (5), wherein a plurality of the nozzle cartridges is disposed in the transverse direction of the metal strip, so that the discharge ports are arranged at given intervals across an entire range of the transverse direction of the metal strip.

(7) The apparatus for continuous molten metal coating treatment according to any one of the foregoings (1) to (6), wherein a plurality of the nozzle cartridges is disposed in a travelling direction of the metal strip.

(8) The apparatus for continuous molten metal coating treatment according to the foregoing (7), the apparatus capable of forming a multi-layered coating by controlling a type of the molten metal supplied to the chamber of each nozzle cartridge to be different, among the nozzle cartridges disposed at different positions in the travelling direction of the metal strip.

(9) A method for molten metal coating treatment comprising: coating a surface of a metal strip by discharging a droplet of a molten metal toward the surface of the metal strip while the metal strip is continuously travelling, by means of the apparatus for continuous molten metal coating treatment according to any one of the foregoings (1) to (8).

Advantageous Effect

The disclosed apparatus for continuous molten metal coating treatment allows to perform a totally new method for molten metal coating treatment as a method for treating surfaces of a metal strip by molten metal coating, the new method avoiding inherent issues involved in conventional immersion coating processes and spray coating processes.

And by means of the disclosed method for molten metal coating treatment, it is possible to treat surfaces of a metal strip by molten metal coating while avoiding inherent issues in conventional immersion coating and spray coating processes.

DETAILED DESCRIPTION

Figure 1:
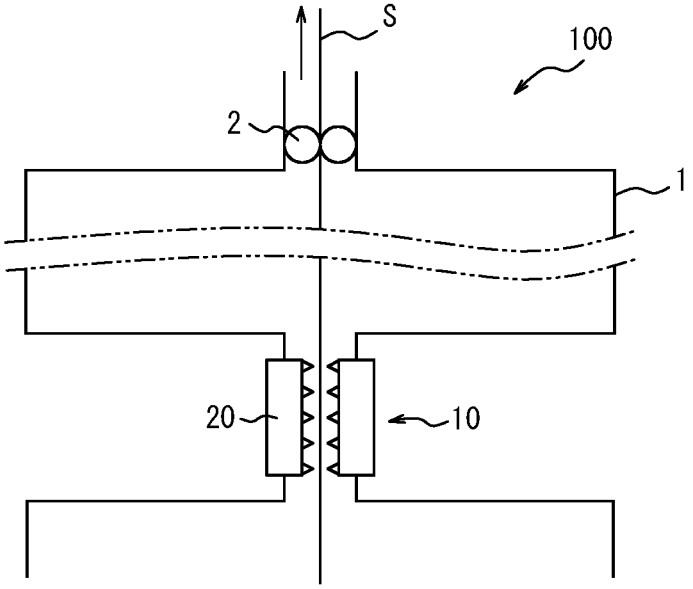
FIG. 1 is a schematic side view of an apparatus for continuous molten metal coating treatment 100 according to one embodiment of the present disclosure.
Figure 2:
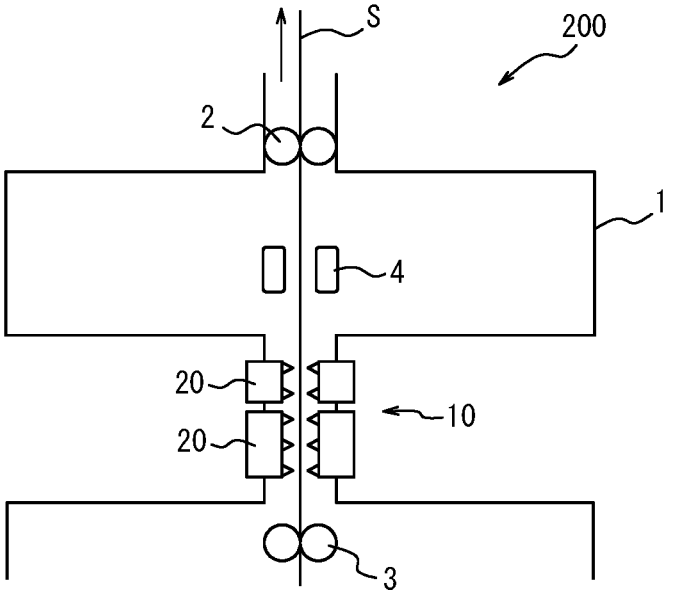
FIG. 2 is a schematic side view of an apparatus for continuous molten metal coating treatment 200 according to another embodiment of the present disclosure.

Each apparatus for continuous molten metal coating treatment 100, 200 according to one embodiment of the present disclosure as respectively illustrated in FIG. 1 and FIG. 2 includes a coating furnace 1 and a nozzle system 10, the coating furnace 1 defining a space of a non-oxidizing atmosphere in which a metal strip S continuously travels, while the nozzle system 10 attached to the coating furnace 1 and capable of discharging molten metal droplets toward a surface of the metal strip S. And in a method for molten metal coating treatment according to one embodiment of the disclosure, a surface of a metal strip S is coated by discharging droplets of a molten metal toward the surface of the metal strip S continuously travelling, by means of these apparatuses for continuous molten metal coating treatment 100, 200.

The disclosure characteristically discharges droplets of the molten metal toward surfaces of the metal strip S utilizing an electromagnetic force (the Lorentz force) by the nozzle system 10. The nozzle system 10 will now be described with reference to FIGS. 3 to 6.

Figure 3:
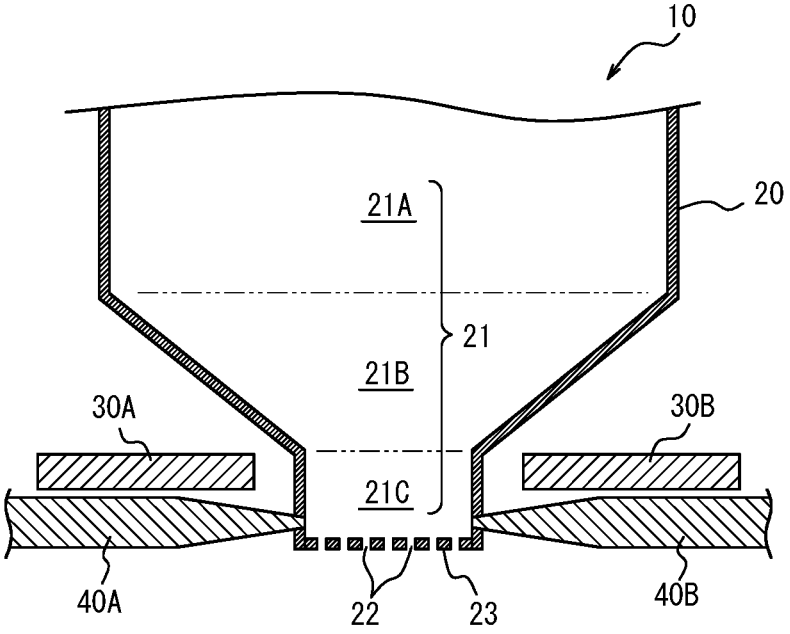
FIG. 3 is a sectional view around a tip of a nozzle cartridge 20 in a nozzle system 10 used in one embodiment of the present disclosure.
Figure 4:
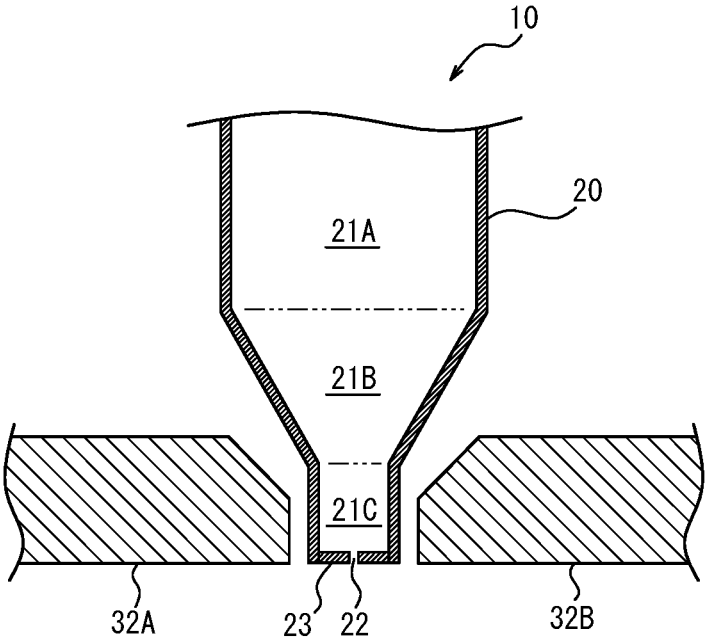
FIG. 4 is a sectional view, that is perpendicular to FIG. 3, around the tip of the nozzle cartridge 20 in the nozzle system 10 used in one embodiment of the present disclosure.
Figure 5:
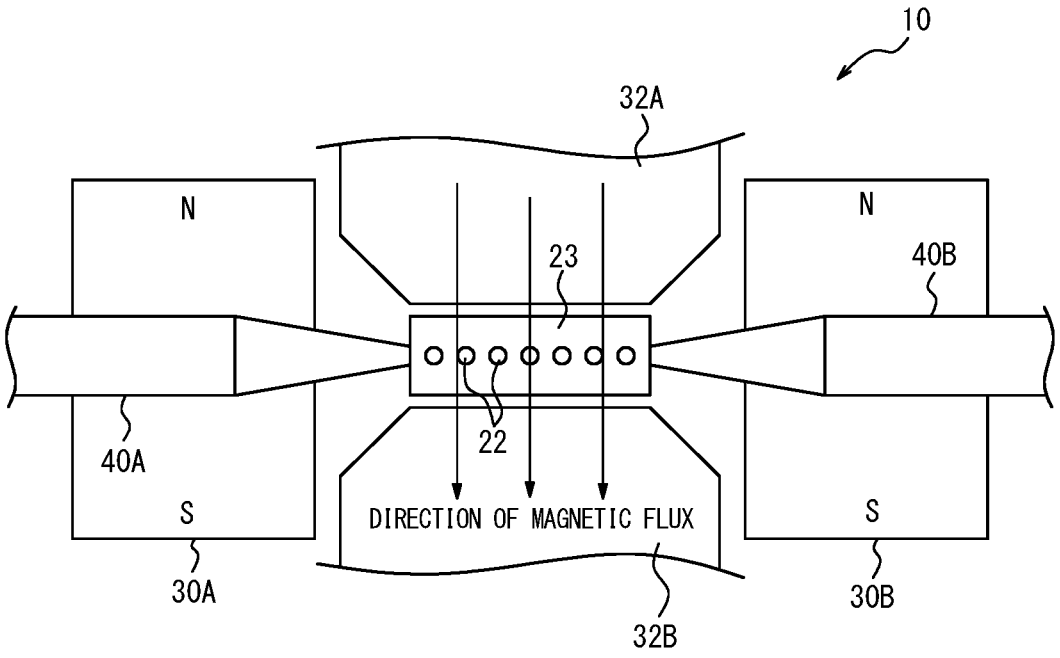
FIG. 5 is a view around the tip of the nozzle cartridge 20 illustrated in FIGS. 3 and 4, the view from a direction in which droplets are discharged.

Firstly, the nozzle system 10 includes a nozzle cartridge 20 as illustrated in FIGS. 3 to 5. The nozzle cartridge 20 defines a chamber 21 through which the molten metal passes, and has a nozzle 23 on its tip. The nozzle 23 defines a discharge port(s) 22 communicating from a chamber 21C.

While FIGS. 3 and 4 illustrate only a vicinity of the tip of the nozzle cartridge 20, the nozzle cartridge 20 is connected to a supply mechanism (not depicted) capable of continuously supplying the molten metal to the chamber 21. The supply mechanism is formed, for example, of a tank that can retain metal heated into a molten state at high temperature by induction heating, as well as of an electromagnetic pump for stably supplying the molten metal to the nozzle cartridge. Alternatively, the molten metal may be automatically supplied by gravity with disposing the tank for storing the molten metal vertically above the cartridge.

In this embodiment, the chamber 21, defined in the vicinity of the tip of the nozzle cartridge 20, consists of a first chamber 21A in a cuboid shape; a third chamber 21C in a cuboid shape and being smaller in size than the chamber 21A; and a second chamber 21B joining these chambers 21A and 21C as well as having a tapered shape as in sectional views of FIG. 3 and FIG. 4. A portion defining the third chamber 21C corresponds to the most tipped end of the nozzle cartridge 20. As illustrated in FIG. 5, the nozzle 23 on the tip of the nozzle cartridge 20 is a rectangular plate-like member having multiple discharge ports 22 formed at given intervals along its longitudinal direction. In a word, the discharge ports 22 are through-holes for penetrating the nozzle 23 from the chamber 21 to external air.

Heat resistant graphite, various kinds of ceramics, and the like can be suitably used as materials for the nozzle cartridge 20 and the nozzle 23. It is preferable to wind an electromagnetic coil (not depicted) around the nozzle cartridge 20 so that the molten metal can be remained at high temperature by induction heating.

The nozzle system 10 includes a magnetic flux generation mechanism and a current generation mechanism. The magnetic flux generation mechanism is for generating magnetic flux in a given direction in at least a part of the chamber 21, while the current generation mechanism is for sending an electric current, in a direction perpendicular to the above given direction, to the molten metal positioned in the at least a part of the chamber where the magnetic flux is applied. The current generation mechanism according to the present embodiment will now be described with reference to FIG. 3 and FIG. 5. And the magnetic flux generation mechanism according to the present embodiment will be described with reference to FIG. 4 and FIG. 5.

As illustrated in FIG. 3, the current generation mechanism of the present embodiment include a pair of pin-shaped electrodes 40A and 40B. A pointed end of each of the electrodes 40A and 40B is inserted into the through-hole provided on the portion defining the third chamber 21C of the nozzle cartridge 20 so as to physically and electrically contact with the molten metal in the third chamber 21C. The pointed ends of the electrodes 40A and 40B face each other. In addition, the current generation mechanism of the present embodiment include a DC power supply (not depicted) electrically connected to the electrodes 40A and 40B, as well as a controller (not depicted) of the DC power supply. The controller controls the DC power supply to send pulsed direct current to the molten metal in the third chamber 21C via the electrodes 40A and 40B. Shapes, amplitude and pulse width of current pulse will be properly controlled by the controller. In the present embodiment, a line connecting the pointed ends of the electrodes 40A and 40B accords with the longitudinal direction of the nozzle 23, i.e., the direction in which the discharge ports 22 are arranged. This direction additionally accords with the direction in which the electric current flows to the molten metal in the third chamber 21C. The direction of the direct current may be from the electrode 40A toward the electrode 40B of FIG. 3 or may be the reverse thereof. Although no particular limitations are placed on materials for the electrodes 40A and 40B, materials such as tungsten are suitably used as they can withstand use at high temperature.

As illustrated in FIGS. 3 to 5, the magnetic flux generation mechanism of the present embodiment may be composed of a pair of permanent magnets 30A and 30B for generating magnetic flux, and a pair of collectors 32A and 32B for focusing the generated magnetic flux to the third chamber 21C. The pair of permanent magnets 30A, 30B is respectively disposed above the electrodes 40A, 40B such that the third chamber 21C is sandwiched in between, and such that north poles are placed on the same side while south poles are accordingly placed on the same side as well. The pair of collectors 32A and 32B is disposed between the pair of permanent magnets 30A and 30B. Shape of the collectors 32A and 32B made of iron is designed such that the collectors are narrowing toward the tip of the nozzle cartridge so as to be able to focus the magnetic flux generated by the magnets to at least a part of the chamber, to the third chamber 21C in the present embodiment (see FIG. 4). The collectors 32A and 32B are made of magnetic guiding materials such as iron. This composition enables to produce magnetic flux into the third chamber 21C in a direction perpendicular to the direction of the electric current (see FIG. 5).

In the present embodiment, the pulsed current is applied to the molten metal in the third chamber 21C for either a right side or a left side of FIG. 3, within the state that the magnetic flux is being generated in the third chamber 21C to a right or left direction of FIG. 4. This produces the Lorentz force acting on the molten metal in the third chamber 21C for a direction perpendicular to both the direction of the magnetic flux and the direction of the electric current. This Lorentz force acts to eject droplets of the molten metal from the discharge ports 22 toward surfaces of the metal strip.

Figure 6:
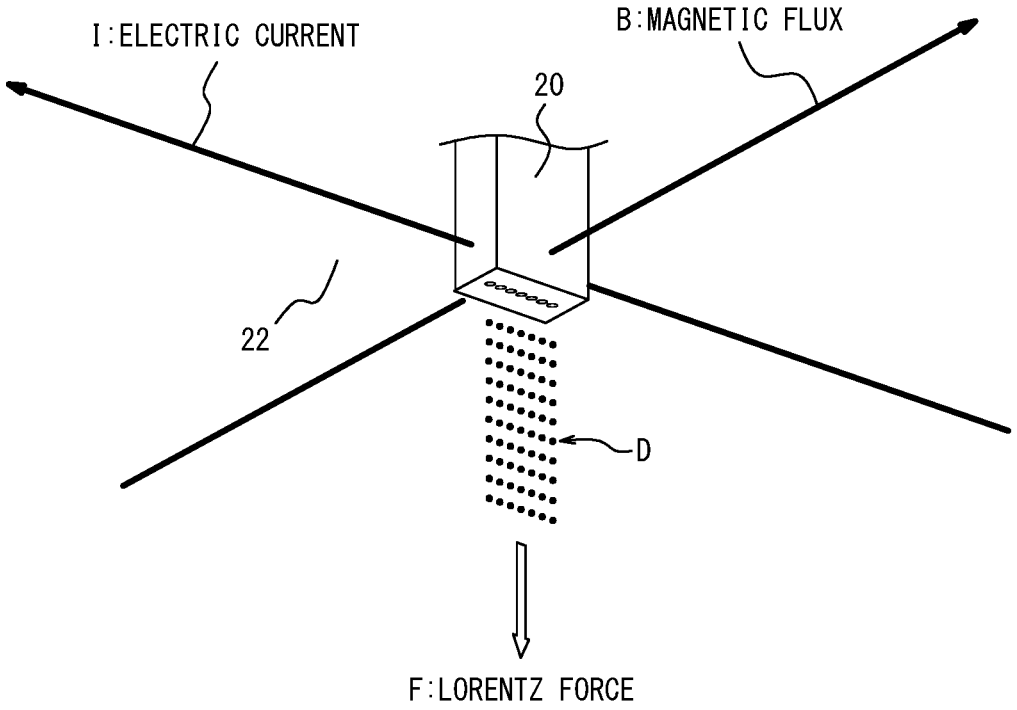
FIG. 6 is a schematic diagram describing a principle of discharging molten metal droplets from a nozzle.

A principle of this ejecting will be briefly described with reference to FIG. 6. When the magnetic flux B and the pulsed current I are directed as illustrated in FIG. 6, as a first aspect, the Lorentz force F will have a pulsating action on the molten metal in the third chamber 21C in a downward direction of FIG. 6 (in other words, in a direction from inside of the chamber toward the external air via the discharge ports). The molten metal is then pushed out toward the discharge ports 22 due to the action of the pulsating Lorentz force generated directly on the molten metal. At this point, the molten metal is discharged from the discharge ports 22 in a form of droplets D as the molten metal has a considerably high surface tension.

As a second aspect, when the pulsed current is directed opposite to the direction illustrated in FIG. 6, the Lorentz force F will have a pulsating action on the molten metal in the third chamber 21C in an upward direction of FIG. 6 (in other words, in a direction from the external air toward the inside of the chamber via the discharge ports). The molten metal is also discharged from the discharge ports 22 due to this action of the Lorentz force. In this case, the molten metal in the discharge ports 22 will have concave menisci toward the inside of the chamber while the Lorentz force of a certain pulse is acting on the molten metal. However, the menisci will be pushed back during a period of time when no Lorentz force is generated between the pulses. At this point, the molten metal is discharged from the discharge ports 22 in a form of droplets, the droplets formed due to the surface tension of the molten metal considerably high enough to break the menisci.

Techniques for discharging the molten metal using the Lorentz force are already known as disclosed in WO2010/063576 and WO2015/004145. The former publication describes a discharging technique corresponding to the aforementioned first aspect. And the latter publication describes discharging techniques corresponding to the first aspect and the second aspect in detail along with their discharging principles. In general, finer droplets can be obtained in the second aspect than in the first aspect. One of the aspects may be selected depending on a desired droplet diameter of the molten metal.

The present disclosure applies this technique for discharging the molten metal utilizing the Lorentz force to a continuous molten metal coating treatment, and achieves uniform coatings. Although a method for controlling to discharge the molten metal by means of a piezoelectric element as in inkjet technologies might be an option, such a method is not suitable for use in high temperature environment due to problems related to heat resistance. This method therefore requires heat protection measures with a combination of heat insulations and cooling mechanisms. In addition, the method has problems such as shorter maintenance or replacement cycles because of a shorter head lifetime. On the other hand, improved heat resistance as well as a longer head lifetime are obtainable in the method for discharging the molten metal from a nozzle by utilizing the electromagnetic force. Preferable conditions for achieving the uniform coatings in the present disclosure will be described below.

Figure 8:
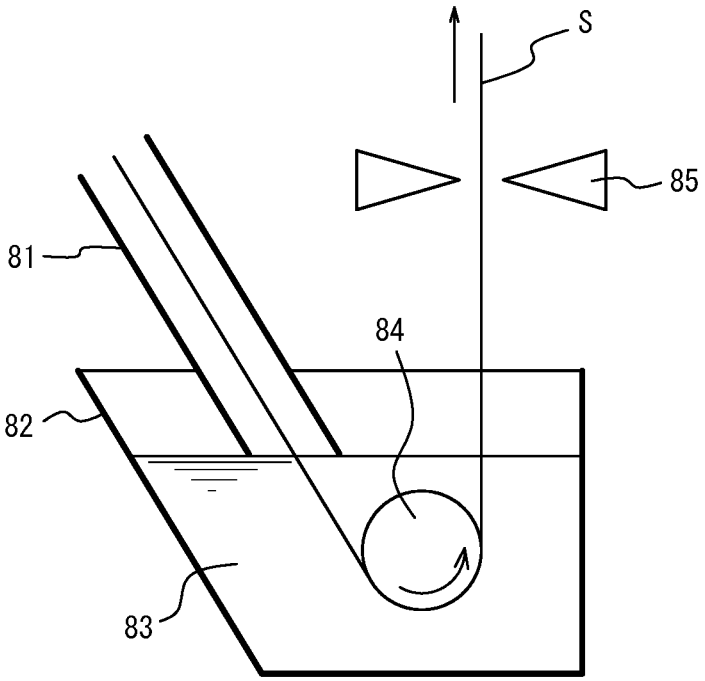
FIG. 8 is a schematic side view of a conventional continuous hot-dip galvanizing line.

With reference to FIG. 1 and FIG. 2, the metal strip S continuously runs in the non-oxidizing atmosphere introduced with non-oxidizing gas, and is coated with the molten metal discharged as droplets from the nozzle system 10. Without any particular limitations are placed on shape of the coating furnace 1, a vertical furnace as illustrated in FIG. 1 and FIG. 2 may be employed. In a situation of coating the metal strip S annealed in the general continuous annealing furnace as illustrated in FIG. 8, it is preferable that the inside of the coating furnace 1 is spatially in communication with the snout of the continuous annealing furnace.

Atmosphere in the coating furnace 1 needs to be the non-oxidizing atmosphere. An oxygen concentration in the furnace is preferably less than 200 ppm, and more preferably 100 ppm or less, from the perspective of sufficiently preventing non-coating from occurring due to oxidized surfaces of the metal strip and consequent deteriorated wettability. Furthermore, the oxygen concentration in the furnace is preferably 0.001 ppm or more from the perspective of cost restriction in removing oxygen. Although no particular limitations are placed on atmosphere gases in the coating furnace 1 as long as the gases are of non-oxidizing, examples of which that can be suitably used include one or more of the gases selected from an inert gas such as $N_2$ and Ar; and a reducing gas such as $H_2$.

While the metal strip S and the nozzle system 10 are arranged for coating both faces of the metal strip in a vertical furnace according to FIG. 1, other layouts such for coating single face at a time or both faces of the metal strip in a horizontal furnace are also applicable. A preferred configuration is such that the nozzle position can be appropriately adjusted according to a gap between the nozzle and the metal strip measured by a sensor or the like. This is because a distance between the nozzle system 10 and the metal strip S will not be constant as the distance is affected by warping, vibration, and so on of the metal strip.

In order to suppress the oxidation of the metal strip and the molten metal, it is preferable to provide a sealing device 2, for separating the space of the non-oxidizing atmosphere from air, on a side in the coating furnace 1 where the metal strip leaves. Examples of the sealing device include partitions such as a gas curtain and a slit; or sealing rollers as illustrated in FIG. 1 and FIG. 2. The sealing device enables to reduce the oxygen concentration in the furnace to 100 ppm or less, and to satisfyingly suppress defects such as the non-coating.

Dimension of the nozzle 23 is not particularly limited, however, preferred is a rectangle of about 1 to 10 mm for a longitudinal direction of the metal strip and about 1 to 200 mm for a transverse direction of the metal strip, with reference to FIG. 5. With the nozzle having a length of less than 1 mm for the transverse direction of the metal strip, it will be difficult to effectively coat the metal strip across its transverse direction without additional complicated mechanisms such as nozzle scanning. With the nozzle having a length of more than 200 mm for the transverse direction of the metal strip, it will be difficult to apply the Lorentz force uniformly across the transverse direction of the nozzle, making the uniform discharging among discharge ports difficult.

Referring to FIG. 5, multiple discharge ports 22 are preferably disposed, along the transverse direction of the metal strip, on the nozzle 23 on the tip of the nozzle cartridge. Diameters of the discharge ports 22 and intervals between adjacent discharge ports are determined in consideration of the following discharging conditions.

For discharging the molten metal droplets, the pulsed current requires to be managed for controlling droplet diameters and discharging amount according to line speed, desired coating thickness or resolution. And in managing the pulsed current, frequency needs to be set high to a certain degree in order to form small droplets. In that sense the frequency of the pulsed current is preferably 100 Hz or more. More preferred is 500 Hz or more. In addition, the frequency of the pulsed current is preferably 50000 Hz or less because of a limit of speed at which the molten metal can be filled into the nozzle. Further, strong magnetic field and current output are necessary for the molten metal, having high specific gravity, to be discharged such that the molten metal can speed up enough to land onto the metal strip. These will be parameters that need to be appropriately adjusted according to shapes of the discharge ports, required droplet diameters, types of molten metals to be used, and so on. In general, droplet volume V is given by the following formula.

$$V = \frac{\pi r^2 v}{2f}$$

In the formula, r is a radius of the discharge port, v is a discharging velocity, and f is a resonance frequency of a pressure wave in the chamber. The radius of the discharge port can be reduced for reducing the droplet diameter (the droplet volume). Or the resonance frequency can be set high for the smaller droplet diameter.

Our various studies also found that the droplet diameter was almost the same as or slightly larger than the size of the discharge port. In the present embodiment, it is preferable to design an average droplet diameter to be 100 μm or less in terms of achieving the uniform coatings. In order to stably discharge fine droplets having the droplet diameter of 100 μm or less, it is preferable to set the discharge port to have a diameter of 60 μm or less, and more preferably 50 μm or less. Moreover, the diameter of the discharge port is preferably set to 2 μm or more in terms of maintaining stable filling and discharging of the molten metal droplets. Therefore, a preferred range of the average droplet diameter is 2 μm or more as well. As described herein, "droplet diameter" refers to a diameter of a sphere when taking the droplet as the sphere having the volume equal to that of the droplet. A method for measuring the droplet diameter is as follows. The measurement was begun with discharging droplets of the molten metal onto a metal plate. One of the discharged and then solidified droplets was measured by a laser microscope to obtain a 3D height distribution. The obtained 3D height distribution was used for calculating the droplet volume. Finally, the droplet diameter was resulted by converting into a diameter of a sphere having the equivalent volume as the calculated droplet volume. The average droplet diameter is defined as an arithmetic mean of the droplet diameters calculated for freely and randomly selected 10 or more droplets discharged onto the metal plate.

It is preferable to set the interval between adjacent discharge ports (a distance between centers of the discharge ports) in a range of 10 to 250 μm in terms of obtaining the uniform coatings under the aforementioned conditions.

In addition, magnetic field strength is preferably 10 mT or more, and more preferably 100 mT or more, in order to discharge the droplets so that the droplets can land fast onto the metal strip. Moreover, the magnetic field strength is preferably 1300 mT or less because of a limit of magnetic force of the permanent magnet.

Figure 7:
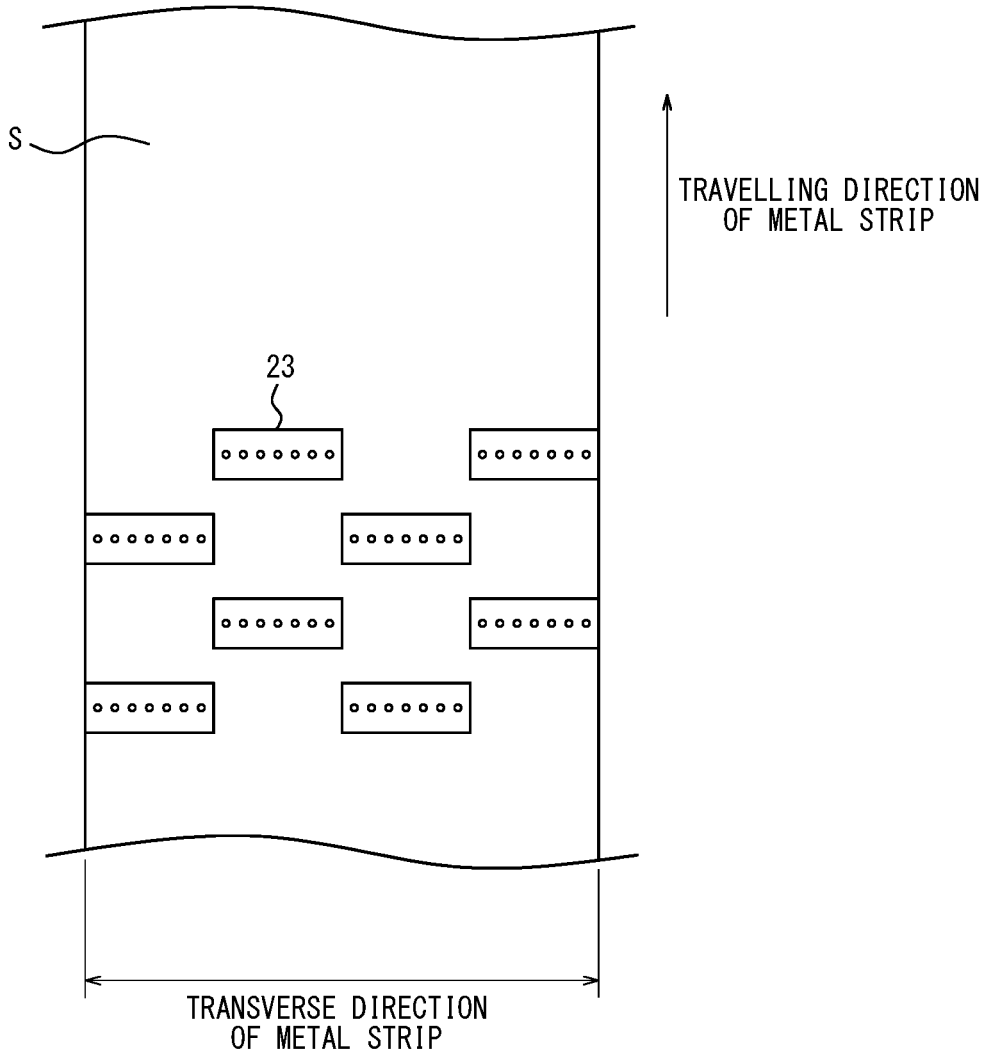
FIG. 7 is a layout of a nozzle system in Examples.

In order to uniformly coat a wide metal strip subjected to sheet passing at high speed, it is necessary to dispose multiple nozzle cartridges in the transverse direction of the metal strip, so that the discharge ports are arranged at given intervals across an entire range of the transverse direction of the metal strip. In addition, disposing multiple nozzle cartridges in a travelling direction of the metal strip is also preferable. A coating speed can be improved with these arrangements. As an example of the nozzle cartridge arrangement, the nozzle cartridges may be disposed in multiples rows along the transverse direction as well as the travelling direction of the metal strip, so that the nozzles 23 are disposed having relative positions as illustrated in FIG. 7.

It is desirable to configure the facilities in such a way that the nozzle replacement will not affect an overall atmosphere in the furnace by providing an additional sealing device on an upstream side of the nozzle as well with respect to the travelling direction of the metal strip. This facilitates the replacement of the nozzles and nozzle cartridges.

As for a temperature of the metal strip S to be coated, the desired temperature is (Tu −20° C.) or more, i.e., the desired temperature is equal to or higher than Tu −20° C., where a melting point of the molten metal used for coating is expressed in Tu (° C.). This desired temperature is for coating a surface smoothly and uniformly. It is possible to obtain smooth coated faces when the temperature of the metal strip is (Tu −20° C.) or more, as the droplets landed onto the metal strip surface do not solidify immediately and exert its leveling ability. For that reason, while not illustrating in FIG. 1 or FIG. 2, the apparatus for continuous molten metal coating treatment 100, 200 according to the present embodiment preferably includes a heating mechanism configured to heat the metal strip, and a controller of the heating mechanism configured to control the temperature of the metal strip to (Tu −20° C.) or more (i.e., a controller of the heating mechanism configured to control the metal strip to a temperature equal to or higher than Tu −20° C.). In addition, it is preferable to control the temperature of the metal strip to (a melting point of the metal strip −200° C.) or less, i.e., a temperature equal to or lower than a melting point of the metal strip −200° C., as the sheet passing of the metal strip itself will be difficult when the temperature of the metal strip is close to its softening point or melting point. For example, radiant tubes, induction heating, infrared heating, and electrical resistance heating are used for the heating, while gas jets, mist, and roller quenching are used for cooling.

In contrast to above, the temperature of the metal strip surface is set below Tu −20 (° C.) if one desires to maintain the shape of the droplets to obtain a predetermined surface texture without leveling of the molten metal after landing. And in a case where the surface is coated with some added patterns, formed fine shapes, or printed text and so on, the temperature of the metal strip surface is set less than Tu −20 (° C.), and more desirably (Tu −40° C.) or less, i.e., a temperature equal to or lower than Tu −40° C. In such a case, the temperature of the metal strip is preferably set to 10° C. or more because the metal strip of excessively low temperature will become a brittle material having difficulty in the sheet passing.

Further referring to FIG. 1, a distance within the furnace to the side where the metal strip leaves on the downstream side of the nozzle system 10 is set to have a length long enough for the molten metal after the coating to solidify. Various facilities may be added to this downstream side. The surface may be flattened after coated, for example, by gas injection in order for smoother coated surface. A cooling device such as gas jet may be provided as well if one desires to solidify the coating faster. Moreover, the molten metal may also be discharged onto the metal strip heated to high temperature, or a heating device such as a burner and induction heating may also be provided if one wants to treat the coated layer to be alloyed.

Furthermore, the facilities may be configured to have a separate system capable of injecting different types of the molten metals so as to be able to alter the type of the molten metal injected into the chamber of each nozzle cartridge. This configuration allows to obtain a multilayer coating or composite coating formed of different types of the molten metals. As a specific example, such multi-layered coatings can be formed by controlling the type of the molten metal supplied to the chamber of each nozzle cartridge to be different among the nozzle cartridges 20 disposed at different positions in the travelling direction of the metal strip, as illustrated in FIG. 2. Coating in a multiplayer or composite form can be thus easily performed. The configuration above can also give more freedom in coating design, impart functions such as corrosion resistance, adhesion of coating materials, and workability, resulting in highly functionalized coatings.

In some cases, the metal strip travelling in the furnace may warp as a result of effects of vibration or defective shapes. For such a reason, it is preferable to install a damping-straightening mechanism, for suppressing the metal strip from vibrating or warping, on at least one of the upstream side or the downstream side of the nozzle system with respect to the travelling direction of the metal strip. For example, FIG. 2 illustrates supporting rollers 3 as an example of a contact damping-straightening mechanism, and electromagnetic coils 4 as an example of a non-contact damping-straightening mechanism. The non-contact type is preferably employed on the downstream side of the nozzle system because it is better for the surface after the coating to stay untouched until the coated material solidifies.

A distance from the nozzle surface (a tip of the discharge port) to the metal strip is preferably set to greater than 0.2 mm and less than 10 mm. With the distance of 0.2 mm or less, there is a risk that the metal strip possibly contacts with the nozzle if the metal strip could not be damped sufficiently. And with the distance of 10 mm or more, gaps occurred in the landing positions of the metal droplets, as a result of effects of gas flows around the nozzle, will make the uniform coatings difficult.

According to the embodiment described above, it is possible to apply the molten metal coating treatment to surfaces of the metal strip continuously travelling, while averting the problems inherent in conventional immersion coating processes and spray coating processes. Examples of the metal strip include, without particularly limiting to, a steel strip. And examples of the molten metal to be discharged as droplets include, again, without particularly limiting to, molten zinc. The preferred conditions described in the embodiment may be adopted individually or may be adopted in any combination.

EXAMPLES

One face of a steel strip having a sheet thickness of 0.4 mm and a sheet width of 100 mm was galvanized using the apparatus illustrated in FIG. 2. Evaluations of coating weight and appearance were conducted for the hot dip galvanized steel strip. The galvanizing was performed with discharging molten zinc droplets by adjusting output of a 100 kW power supply and controlling a frequency of pulsed current. A nozzle diameter was set to 30 μm, and a distance from the nozzle tip to the steel strip was set to 3 mm. Nozzles were arranged at intervals where 100 nozzles were disposed per inch in the transverse direction (width direction). And the nozzle systems, dischargeable over a range of 25.4 mm in the transverse direction, were arranged in four rows in a longitudinal direction, each of the rows having 2 nozzle systems in the transverse direction as illustrated in FIG. 7. Atmosphere in the furnace was composed of 5%-$H_2$ and 95%-$N_2$. The coating weight was obtained by observing cross-sectional images at 10 randomly selected points on the coating with a microscope, measuring coating thicknesses therefrom, and then calculating its average value. A coating process by immersing into a molten metal bath as illustrated in FIG. 8 was also performed as a conventional process. An average droplet diameter calculated from randomly selected 10 droplets by means of the aforementioned method is reported in Table 1.

Appearance of the coating was judged according to the following criteria.

Good: No unevenness in the appearance or discoloration is visually observed.

Fair: Tolerable as a product though minor unevenness in the appearance and/or minor discoloration is visually observed.

Poor: Obvious unevenness in the appearance and/or obvious discoloration is visually observed.

The non-coating was judged according to the following criteria.

Good: No non-coating is visually observed.

Fair: Tolerable as a product though minor non-coating is visually observed.

Poor: Obvious non-coating is visually observed.

The splashing was judged according to the following criteria.

Good: No splashing is visually observed.

Fair: Tolerable as a product though minor splashing is visually observed.

Poor: Obvious splashing is visually observed.

TABLE 1

| Category | Condition | Line speed [m/min] | Temperature of steel strip A [° C.] | Melting point of coating B [° C.] | A − B [° C.] | Frequency of pulsed current [Hz] | Average droplet diameter [μm] | Oxygen concentration in furnace [ppm] | Coating thickness [μm] | Appearance of coating | Non-coating | Splashing |
|---|---|---|---|---|---|---|---|---|---|---|---|---|
| Example | 1 | 30 | 500 | 420 | 80 | 3000 | 31 | 10 | 4 | Good | Good | Good |
| Example | 2 | 30 | 480 | 420 | 60 | 3000 | 31 | 10 | 5 | Good | Good | Good |
| Example | 3 | 30 | 450 | 420 | 30 | 3000 | 31 | 10 | 4 | Good | Good | Good |
| Example | 4 | 30 | 420 | 420 | 0 | 3000 | 31 | 10 | 4 | Good | Good | Good |
| Example | 5 | 30 | 400 | 420 | −20 | 3000 | 31 | 10 | 4 | Good | Good | Good |
| Example | 6 | 30 | 380 | 420 | −40 | 3000 | 31 | 10 | 5 | Fair | Good | Good |
| Example | 7 | 30 | 450 | 420 | 30 | 500 | 33 | 10 | 5 | Good | Good | Good |
| Example | 8 | 30 | 450 | 420 | 30 | 100 | 36 | 10 | 6 | Good | Good | Good |
| Example | 9 | 30 | 450 | 420 | 30 | 50 | 40 | 10 | 10 | Good | Good | Good |
| Example | 10 | 30 | 450 | 420 | 30 | 10 | 48 | 10 | 15 | Good | Good | Good |
| Example | 11 | 30 | 450 | 420 | 30 | 3000 | 31 | 50 | 5 | Good | Good | Good |
| Example | 12 | 30 | 450 | 420 | 30 | 3000 | 31 | 100 | 5 | Good | Good | Good |
| Example | 13 | 30 | 450 | 420 | 30 | 3000 | 31 | 200 | 6 | Good | Fair | Good |
| Example | 14 | 50 | 450 | 420 | 30 | 5000 | 29 | 10 | 4 | Good | Good | Good |
| Example | 15 | 80 | 450 | 420 | 30 | 10000 | 28 | 10 | 5 | Good | Good | Good |
| Conventional Example | 16 | 50 | 480 | 420 | 60 | — | — | 10 | 5 | Poor | Good | Poor |
| Conventional Example | 17 | 80 | 480 | 420 | 60 | — | — | 10 | 7 | Poor | Good | Poor |

As reported in Table 1, coating treatments without defects of the splashing or the dross were possible in the present Examples. Under the condition 6 where the temperature of the steel strip is low out of the preferred range of the present disclosure, the minor unevenness in the leveling occurred on the molten metal, resulting in slightly unfavorable appearance though it was still within the acceptable range. Reducing in the frequency of the electric current was found to make the stable discharging of the fine droplets difficult, and as a result the coating thickness was increased. Furthermore, under the condition 13 where the oxygen concentration in the furnace is 200 ppm, the non-coating in a very small area was barely confirmed though it was still within the acceptable range as a product.

In addition, the coating was performed using a nozzle head respectively made to have the nozzle diameter of 50 μm and 60 μm under the conditions 1 to 5 of Table 1 for the purpose of comparison. As a result, coating treatments without defects of the splashing or the dross were possible though the coating thickness was increased to 10 to 11 μm and 16 to 17 μm, respectively. The average droplet diameter of randomly selected 10 droplets by means of the aforementioned method was 52 μm and 62 μm, respectively.

Gas wiping was performed as illustrated in FIG. 8 as a conventional method. Slit width of a wiping nozzle was set to 0.8 mm, a distance between the nozzle and the steel strip was set to 10 mm, and a pressure in the nozzle was set to 60 kPa. The splashing of the molten metal occurred as a result. Moreover, formation of the dross (metal oxide), causing surface defects, was confirmed within and on the zinc bath.

While a zinc-aluminum alloy containing 0.2% by mass of Al is used as the molten metal in the Example, the present method is applicable to various types of the molten metals.

INDUSTRIAL APPLICABILITY

The present disclosure provides a fully new method for molten metal coating treatment as well as an apparatus for continuous molten metal coating treatment capable of carrying out such a method. The method, as a method for treating surfaces of a metal strip by molten metal coating, avoids inherent issues involved in conventional immersion coating processes and spray coating processes. The disclosure is therefore industrially highly useful.

REFERENCE SIGNS LIST

100 Apparatus for continuous molten metal coating treatment
200 Apparatus for continuous molten metal coating treatment
1 Coating furnace
2 Sealing device
3 Supporting roller (Damping-straightening mechanism)
4 Electromagnetic coil (Damping-straightening mechanism)
10 Nozzle system
20 Nozzle cartridge
21 Chamber
22 Discharge port
23 Nozzle
30 Permanent magnet (Magnetic flux generation mechanism)
32 Collector (Magnetic flux generation mechanism)
40 Electrode (Current generation mechanism)
S Metal strip

The invention claimed is:

1. An apparatus for continuous molten metal coating treatment comprising:

a coating furnace defining a space of a non-oxidizing atmosphere in which a metal strip continuously travels; and a nozzle system attached to the coating furnace and configured to discharge a molten metal droplet toward a surface of the metal strip travelling inside the coating furnace, the nozzle system comprising:

a nozzle cartridge defining a chamber through which a molten metal passes, and comprising a nozzle, on a tip of the nozzle cartridge, that defines a discharge port in communication with the chamber;

a magnetic flux generation mechanism configured to generate magnetic flux in a given direction in at least a part of the chamber; and a current generation mechanism configured to send an electric current, in a direction perpendicular to the given direction, to the molten metal positioned in the at least a part of the chamber where the magnetic flux is applied, wherein the nozzle on the tip of the nozzle cartridge comprises a plurality of the discharge ports disposed in a transverse direction of the metal strip, and wherein the nozzle system is configured to discharge the molten metal droplet from the discharge ports toward the surface of the metal strip due to an action of a Lorentz force generated on the molten metal in the at least a part of the chamber by sending the electric current to the molten metal in the at least a part of the chamber using the current generation mechanism.

2. The apparatus for continuous molten metal coating treatment according to claim 1, the apparatus further comprising:

a heating mechanism configured to heat the metal strip; and a controller of the heating mechanism configured to control a temperature of the metal strip to (Tu minus 20) ° C. or more, where a melting point of the molten metal is expressed as Tu in ° C.

3. The apparatus for continuous molten metal coating treatment according to claim 1, the apparatus further comprising a sealing device configured to separate the space of the non-oxidizing atmosphere from air, the sealing device disposed at a side in the coating furnace where the metal strip leaves.

4. The apparatus for continuous molten metal coating treatment according to claim 1, the apparatus further comprising a damping-straightening mechanism configured to suppress the metal strip from vibrating or warping, the damping-straightening mechanism set on at least one of an upstream side or a downstream side of the nozzle system with respect to a travelling direction of the metal strip.

5. The apparatus for continuous molten metal coating treatment according to claim 1, wherein a diameter of each of the discharge ports is 60 μm or less.

6. The apparatus for continuous molten metal coating treatment according to claim 5, wherein a plurality of the nozzle cartridges is disposed in the transverse direction of the metal strip, so that the discharge ports are arranged at given intervals across an entire range of the transverse direction of the metal strip.

7. The apparatus for continuous molten metal coating treatment according to claim 1, wherein a plurality of the nozzle cartridges is disposed in a travelling direction of the metal strip.

8. A method for molten metal coating treatment comprising:

coating a surface of a metal strip by discharging a molten metal droplet toward the surface of the metal strip while the metal strip is continuously travelling inside the coating furnace, using the apparatus for continuous molten metal coating treatment according to claim 1.

9. A method for molten metal coating treatment comprising the step of providing a nozzle system, the nozzle system comprising:

a nozzle cartridge defining a chamber through which a molten metal passes, and comprising a nozzle, on a tip of the nozzle cartridge, that defines a discharge port in communication with the chamber;

a magnetic flux generation mechanism configured to generate magnetic flux in a given direction in at least a part of the chamber; and a current generation mechanism configured to send an electric current, in a direction perpendicular to the given direction, to the molten metal positioned in the at least a part of the chamber where the magnetic flux is applied, wherein the nozzle on the tip of the nozzle cartridge comprises a plurality of the discharge ports disposed in a transverse direction of the metal strip, coating a surface of a metal strip by discharging the molten metal droplet from the discharge ports toward the surface of the metal strip positioned in a non-oxidizing atmosphere, the discharging a droplet of the molten metal effected due to an action of a Lorentz force generated on the molten metal in the at least a part of the chamber by sending the electric current to the molten metal in the at least a part of the chamber using the current generation mechanism.

10. The apparatus for continuous molten metal coating treatment according to claim 1, wherein the current generation mechanism includes a DC power supply and a controller of the DC power supply configured to control the DC power supply to send pulsed direct current to the molten metal.

11. The apparatus for continuous molten metal coating treatment according to claim 10, wherein the controller configured to control the DC power supply to provide a frequency of the pulsed current at 100 Hz or more.

12. The apparatus for continuous molten metal coating treatment according to claim 11, wherein the controller configured to control the DC power supply to provide a frequency of the pulsed current at 50000 Hz or less.

* * * * *